US007248273B2

(12) United States Patent
Hoshino et al.

(10) Patent No.: US 7,248,273 B2
(45) Date of Patent: Jul. 24, 2007

(54) THERMAL ACTIVATION DEVICE

(75) Inventors: Minoru Hoshino, Chiba (JP); Yoshinori Sato, Chiba (JP); Hiroyuki Kohira, Chiba (JP); Masanori Takahashi, Chiba (JP); Tatsuya Obuchi, Chiba (JP)

(73) Assignee: Seiko Instruments Inc. (JP)

( * ) Notice: Subject to any disclaimer, the term of this patent is extended or adjusted under 35 U.S.C. 154(b) by 237 days.

(21) Appl. No.: 11/137,841

(22) Filed: May 25, 2005

(65) Prior Publication Data

US 2005/0274706 A1 Dec. 15, 2005

(30) Foreign Application Priority Data

Jun. 1, 2004 (JP) ..... 2004-163091

(51) Int. Cl.
*B41J 2/315* (2006.01)

(52) U.S. Cl. ..... 347/171

(58) Field of Classification Search ..... 347/171
See application file for complete search history.

(56) References Cited

U.S. PATENT DOCUMENTS 6,975,340 B2 * 12/2005 Hoshino et al. ..... 347/197
2003/0189631 A1 10/2003 Hoshino et al.
2005/0269026 A1 * 12/2005 Takahashi et al. ..... 156/277

FOREIGN PATENT DOCUMENTS

EP 1 403 072 A1 3/2004

* cited by examiner

*Primary Examiner*—Huan Tran
(74) *Attorney, Agent, or Firm*—Adams & Wilks

(57) ABSTRACT

Provided is a thermal activation device including a thermal activation head (11) for thermally activating a heat-sensitive adhesive layer of a sheet material (3) having a printing layer provided on one surface of a sheet-like base material and having the heat-sensitive adhesive layer provided on the other surface thereof, and a platen roller (12) for holding and conveying the sheet material (3), the platen roller (12) being brought into press contact with the thermal activation head (11). Moreover, the thermal activation head (11) thermally activates the heat-sensitive adhesive layer asymmetrically with respect to a centerline in a width direction perpendicular to a conveying direction of the sheet material (3). Furthermore, a plate spring (18) which urges the sheet material (3) to be pressed onto a peripheral surface of the platen roller (12) is provided, the plate spring (18) being located on an upstream side of the thermal activation head (11) in the conveying direction of the sheet material (3).

12 Claims, 7 Drawing Sheets

10
THERMAL ACTIVATION DEVICE

10
THERMAL ACTIVATION DEVICE

20
THERMAL ACTIVATION DEVICE

30
THERMAL ACTIVATION DEVICE

110
THERMAL ACTIVATION DEVICE

THERMAL ACTIVATION DEVICE

BACKGROUND OF THE INVENTION

1. Field of the Invention

The present invention relates to a thermal activation device for thermally activating a heat-sensitive adhesive layer of a sheet material having a printing layer formed on one surface of a sheet-like base material and the heat-sensitive adhesive layer formed on the other surface thereof.

2. Description of the Related Art

For example, in a distribution center and shops, labels for displaying various types of information such as prices and for displaying barcodes for management by means of POS (point of sales) terminals have been used by being attached to articles. As this type of label, a proposal has been made of a label, which is issued using a sheet material having a printing layer formed on one surface of a sheet-like base material and a heat-sensitive adhesive layer formed on the other surface thereof.

In general, a label issuing instrument which issues the label having the heat-sensitive adhesive layer as described above includes a printing apparatus that prints various types of information on a thermal printing layer of the sheet material supplied from the sheet supply apparatus, a cutting apparatus that cuts the sheet material for which the printing has been performed by the printing apparatus, and a thermal activation device that thermally activates the heat-sensitive adhesive layer of the sheet material.

Moreover, as a conventional label issuing instrument including the thermal activation device, there is known a structure in which a guiding apparatus that sags and guides the sheet material is disposed between the cutting apparatus and the thermal activation device (for example, refer to JP 2003-316265 A).

The conventional thermal activation device will be briefly described with reference to the drawing.

As shown in FIG. 7, a conventional thermal activation device 110 includes: a thermal activation head 111 for thermally activating a heat-sensitive adhesive layer of a sheet material 103; a platen roller 112 which is brought into press contact with the thermal activation head 111, sandwiches the sheet material 103 between the platen roller 112 itself and the thermal activation head 111, and conveys the sheet material 103 in the conveying direction that is a direction indicated by an arrow L; a pair of feed-in rollers 113*a* and 113*b* for feeding the sheet material 103 conveyed from the cutting apparatus into the thermal activation device 110; a sheet guide portion 117 for guiding the sheet material 103 conveyed from the cutting apparatus; and a discharge roller 115 for discharging the sheet material 103 thermally activated by the thermal activation head 111 to the outside of the thermal activation device 110.

In the thermal activation device 110 as described above, an outer diameter of the platen roller 112 is set at approximately 12 mm, and outer diameters of the feed-in rollers 113*a* and 113*b* are set at approximately 8 mm. Moreover, in the sheet guide portion 117, an opposing gap d' through which the sheet material 103 is inserted is set at approximately 0.9 mm. A distance e' of the opposing gap d' in the conveying direction of the sheet material 103 is set at approximately 7.8 mm. Moreover, in the thermal activation device 110, a distance f' between an upstream-side holding position of the sheet material 103, where the sheet material 103 is held by the pair of feed-in rollers 113*a* and 113*b*, and a downstream-side holding position of the sheet material 103, where the sheet material 103 is held by the platen roller 112 and the thermal activation head 111, is set at approximately 23.1 mm.

In the thermal activation device 110 constructed as described above, the sheet material 103 fed in from the cutting apparatus side is fed in by the pair of feed-in rollers 113*a* and 113*b*, and is inserted into the opposing gap of the sheet guide portion 117. The sheet material 103 inserted into the opposing gap of the sheet guide portion 117 is further fed in by the feed-in rollers 113*a* and 113*b*, and one end thereof is thus brought into contact with a peripheral surface of the platen roller 112.

The sheet material 103 which is brought into contact with the platen roller 112, is inserted between the platen roller 112 and the thermal activation head 111 as the platen roller 112 is rotationally driven. Then, a heat-sensitive adhesive layer of the sheet material 103 inserted between the platen roller 112 and the thermal activation head 111 is thermally activated by the thermal activation head 111, and the sheet material 103 is conveyed toward the discharge roller 115 by friction force between the sheet material 103 itself and the peripheral surface of the platen roller 112, and is discharged to the outside of the thermal activation device 110 by the discharge roller 115.

Incidentally the label issued from the sheet material having the heat-sensitive adhesive layer is sometimes used in such a manner that the entire surface of the heat-sensitive adhesive layer is not thermally activated evenly, but only a part thereof is thermally activated to form an adhesive region, and the other portions are left as a non-adhesive region which is not thermally activated.

In such a label, for example, one end side as the adhesive region of the label is attached to an article and the other end side as the non-adhesive region is not attached to the article. Moreover, in the label, for example, a tear-off line or the like is provided on a border between the adhesive region and the non-adhesive region, and in a distribution process of such articles, the other end side of the label is cut off and used as a slip for management.

As described above, in the conventional thermal activation device, when the heat-sensitive adhesive layer of the sheet material is thermally activated partially in the width direction perpendicular to the conveying direction of the sheet material, the adhesive region thermally activated by a thermal activation head and the non-adhesive region which is not thermally activated are unevenly present in the width direction of the sheet material.

In the conventional thermal activation device, a heat-sensitive adhesive layer of a sheet material held between a thermal activation head and a platen roller is thermally activated partially at a thermal activation position of the thermal activation head.

For example, with respect to a centerline in a direction of a width which is perpendicular to the conveying direction of the sheet material, in a case where a region from the centerline to one end side is activated and a region from the centerline to the other end side is not activated, with respect to the centerline of the sheet material in the width direction, a friction coefficient between the sheet material and the thermal activation head differs between the adhesive region and the non-adhesive region.

Therefore, the sheet material has a problem in that slippage occurs between the sheet material itself and the platen roller in the non-adhesive region. As a result, the sheet material is conveyed less in the non-adhesive region than in the adhesive region, and a difference occurs in conveying speed by the platen roller in the width direction. Thus, there is a problem in that the sheet material is inclined with respect to the conveying direction, thus being conveyed while skewed, thus causing skew feed.

In the sheet material conveyed while skewed as described above, while a portion thereof where the conveying speed is fast is tightly held by the platen roller and conveyed at approximately the same speed as rotation speed of the platen roller, a portion thereof where the conveying speed is slow is suspended at rest in a deflected state in the vicinity of the front portion of the platen roller. At this time, between the feed-in rollers and the plate roller, a deflection occurs in the portion where the conveying speed of the sheet material is slow. Moreover, when a trailing edge of the sheet material in the conveying direction passes through the feed-in rollers and is detached therefrom, correction of the conveying direction by the feed-in rollers is no longer effected, and accordingly, the extent of such skew feed increases. Furthermore, the discharge rollers hardly have holding force for the sheet material, and accordingly, the function of correcting the conveying direction of the sheet material is hardly obtained.

Hence, in the conventional thermal activation device, the sheet material is inclined as described above, and thus the respective widths of the adhesive region thermally activated by the thermal activation head and the non-adhesive region which is not thermally activated are changed. Accordingly, it has been difficult to form the adhesive region having an intended width on the heat-sensitive adhesive layer of the sheet material.

SUMMARY OF THE INVENTION

It is therefore an object of the present invention to provide a thermal activation device capable of preventing the sheet material to be caused to skew feed in the case of thermally activating the heat sensitive adhesive layer asymmetrically with respect to the centerline of the sheet material in the width direction.

To attain the above-mentioned object of the invention, a thermal activation device of the present invention includes: heating means for thermally activating a heat-sensitive adhesive layer of a sheet material having a printing layer provided on one surface of a sheet-like base material and having the heat-sensitive adhesive layer provided on the other surface thereof; and a platen roller for holding and conveying the sheet material, the platen roller being brought into press contact with the heating means. Further, the heating means thermally activates the heat-sensitive adhesive layer asymmetrically with respect to a centerline in a width direction perpendicular to a conveying direction of the sheet material. In addition, thermal activation device is provided with urging means for urging the sheet material to be pressed onto a peripheral surface of the platen roller, the urging means being located on an upstream side of the heating means in the conveying direction of the sheet material.

According to the thermal activation device of the present invention, which is constructed as described above, the sheet material is pressed onto the peripheral surface of the platen roller by urging force of the urging means. Thus, the slippage occurring between the non-adhesive region of the sheet material which is not thermally activated and the platen roller is suppressed, and the deflection is restrained from occurring in a front portion of the non-adhesive region. Accordingly, the sheet material is allowed to go forward well in the conveying direction by elastic force, so-called stiffness, of the sheet material itself, and conveying force for the sheet material by the platen roller is supplemented. Hence, when the heat-sensitive adhesive layer is thermally activated asymmetrically with respect to the centerline of the sheet material in the width direction, the conveying speed for the sheet material by the platen roller is made substantially even over the width direction of the sheet material, and the sheet material is restrained from being conveyed while skewed with respect to the conveying direction owing to the difference in friction force which occurs in the width direction of the sheet material.

Further, a thermal activation device according to the present invention includes: heating means for thermally activating a heat-sensitive adhesive layer of a sheet material having a printing layer provided on one surface of a sheet-like base material and having the heat-sensitive adhesive layer provided on the other surface thereof; a platen roller for holding and conveying the sheet material, the platen roller being brought into press contact with the heating means; a pair of feed-in rollers for feeding the sheet material toward the heating means; and sheet guide means having an opposing gap, for guiding a position in a thickness direction of the sheet material fed in by the pair of feed-in rollers, the sheet guide means being provided adjacent to the heating means and the platen roller. Besides, the heating means thermally activates the heat-sensitive adhesive layer asymmetrically with respect to a centerline in a width direction perpendicular to a conveying direction of the sheet material. Further, the opposing gap of the sheet guide means is five times or less a thickness of the sheet material.

According to another thermal activation device of the present invention, which is constructed as described above, the opposing gap of the sheet guide means is set at five times or less the thickness of the sheet material. Thus, an occurrence of a deflection in the thickness direction of the sheet material inserted into the opposing gap is regulated, and an amount of deflection is suppressed. Therefore, the sheet material is allowed to go forward well in the conveying direction by the feed-in rollers by the elastic force, so-called stiffness, of the sheet material itself, and the conveying force for the sheet material by the platen roller is supplemented. Hence, when the heat-sensitive adhesive layer is thermally activated asymmetrically with respect to the centerline of the sheet material in the width direction, the sheet material is restrained from being conveyed while skewed with respect to the conveying direction owing to the difference in friction force which occurs in the width direction of the sheet material.

Further, a thermal activation device according to the present invention includes: eating means for thermally activating a heat-sensitive adhesive layer of a sheet material having a printing layer provided on one surface of a sheet-like base material and having the heat-sensitive adhesive layer provided on the other surface thereof; a platen roller for holding and conveying the sheet material, the platen roller being brought into press contact with the heating means; and a pair of feed-in rollers for feeding the sheet material toward the heating means. Besides, the heating means thermally activates the heat-sensitive adhesive layer asymmetrically with respect to a centerline in a width direction perpendicular to a conveying direction of the sheet material. Further, a distance between an upstream-side holding position of the sheet material where the sheet material is held by the pair of feed-in rollers, and a downstream-side holding position of the sheet material where the sheet material is held by the platen roller and the heating means, is equal to or less than a sum of an outer diameter of each of the feed-in rollers and an outer diameter of the platen roller.

According to still another thermal activation device of the present invention, which is constructed as described above, relative positions of the platen roller and the feed-in rollers are made close to each other, and the amount of deflection which occurs in the sheet material between the upstream-side holding position and the downstream-side holding position is suppressed. Therefore, the sheet material is allowed to go forward well in the conveying direction by the feed-in rollers by the elastic force of the sheet material itself, and the conveying force for the sheet material by the platen roller is supplemented. Hence, when the heat-sensitive adhesive layer is thermally activated asymmetrically with respect to the centerline of the sheet material in the width direction, the sheet material is restrained from being conveyed while skewed with respect to the conveying direction owing to the difference in friction force which occurs in the width direction of the sheet material.

As described above, according to the thermal activation device of the present invention, the sheet material is allowed to go forward well in the conveying direction by the elastic force of the sheet material itself, and the conveying force for the sheet material by the platen roller is supplemented. Accordingly, it is possible to restrain the sheet material to be conveyed by the platen roller from being conveyed while skewed with respect to the conveying direction of the sheet material owing to the difference in friction force which occurs in the width direction of the sheet material. Hence, according to the thermal activation device, when the heat-sensitive adhesive layer is thermally activated asymmetrically with respect to the centerline of the sheet material in the width direction by the heating means, the sheet material is restrained from being skewed. Therefore, the adhesive region and the non-adhesive region can be formed well with predetermined widths on the heat-sensitive adhesive layer of the sheet material.

DETAILED DESCRIPTION OF THE PREFERRED EMBODIMENTS

Specific embodiments of the present invention will be described below with reference to the drawings.

Figure 1:
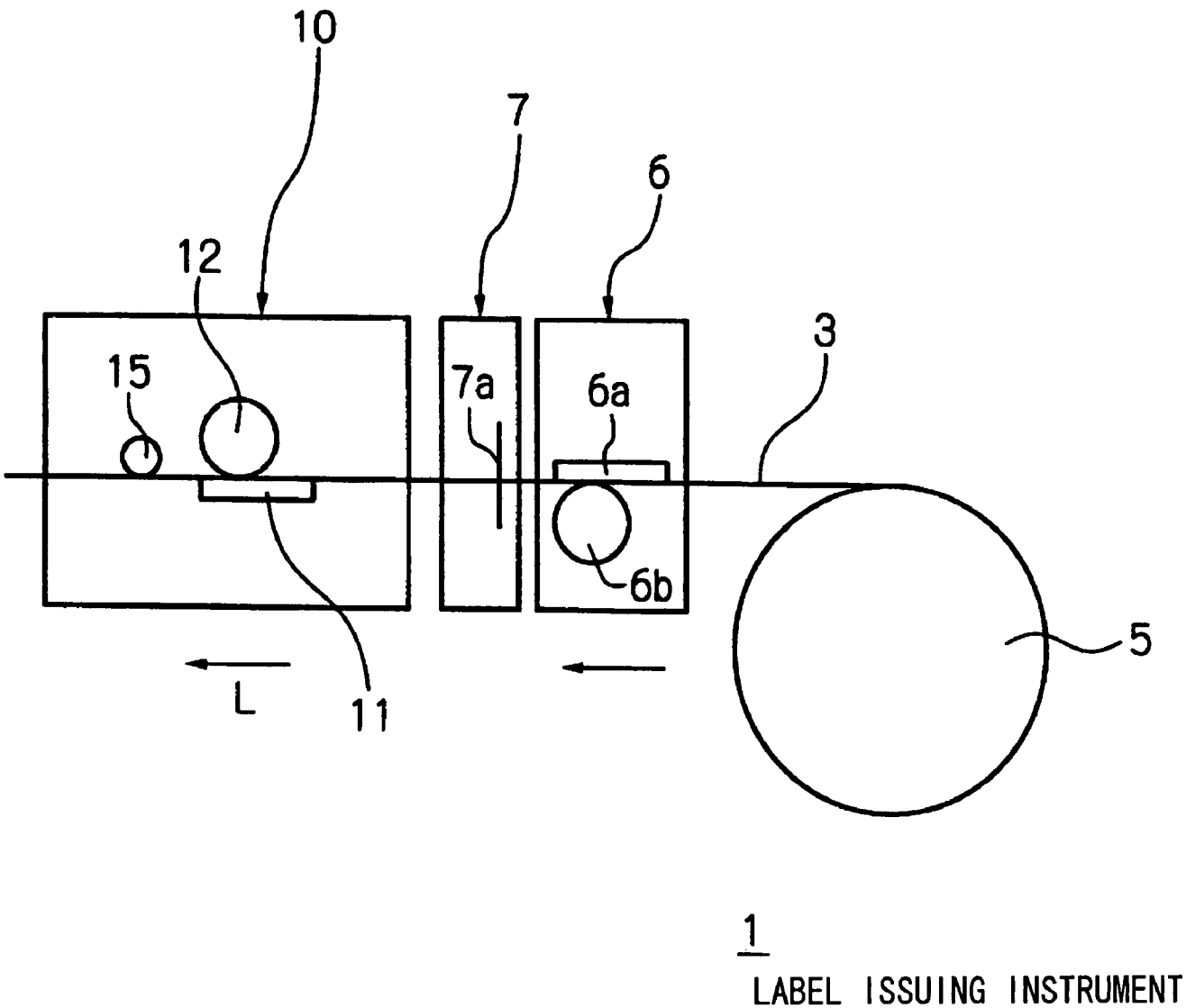
FIG. 1 is a schematic view showing a label issuing instrument including a thermal activation device according to the present invention.

First, a label issuing instrument to be used in the case of issuing a label attached to an article for displaying various types of information on the article will be briefly described. FIG. 1 schematically shows a label issuing instrument according to the present invention.

As shown in FIG. 1, in a label issuing instrument 1, a printing apparatus 6 that prints various types of information on a thermal printing layer of the sheet material 3, a cutting apparatus 7 that cuts the sheet material 3 for which the printing has been performed by the printing apparatus 6, and a thermal activation device 10 that thermally activates a heat-sensitive adhesive layer of the sheet material 3 are arranged in the stated order along a conveyor route of the sheet material 3 in the direction indicated by an arrow L in FIG. 1.

Although not shown, the sheet material 3 includes a sheet-like base material, the thermal printing layer formed on a surface side of the sheet-like base material, and the heat-sensitive adhesive layer provided on a back surface side of the sheet-like base material, and is formed into about 0.1 mm in thickness. Note that, according to needs, as the sheet material, used may be one having a configuration in which a heat-insulating layer for shielding heat conduction from one-side layer of the sheet-like base material to the other-side layer thereof is provided between the sheet-like base material and the thermal printing layer. The sheet material 3 is fed from a sheet roll 5 around which the sheet material 3 is wound around in a roll to be supplied to the printing apparatus 6.

A so-called thermal printer is used as the printing apparatus 6, and the printing apparatus 6 includes a thermal head 6*a* for making the thermal printing layer of the sheet material 3 heat-sensitive, and a platen roller 6*b* brought into press contact with the thermal head 6*a*. While sandwiching the sheet material 3 supplied from the sheet supply apparatus 5 between the thermal head 6*a* and the platen roller 6*b*, the printing apparatus 6 performs printing for the sheet material 3, and conveys the sheet material 3. Note that the printing apparatus 6 may be disposed on a downstream side of the thermal activation device 10 in the conveying direction of the sheet material 3 according to needs. The cutting apparatus 7 includes a cutter 7*a* for cutting the sheet material 3 discharged from the printing apparatus 6 into a desired length, and conveys the sheet material 3 thus cut to the thermal activation device 10.

First Embodiment

Figure 2:
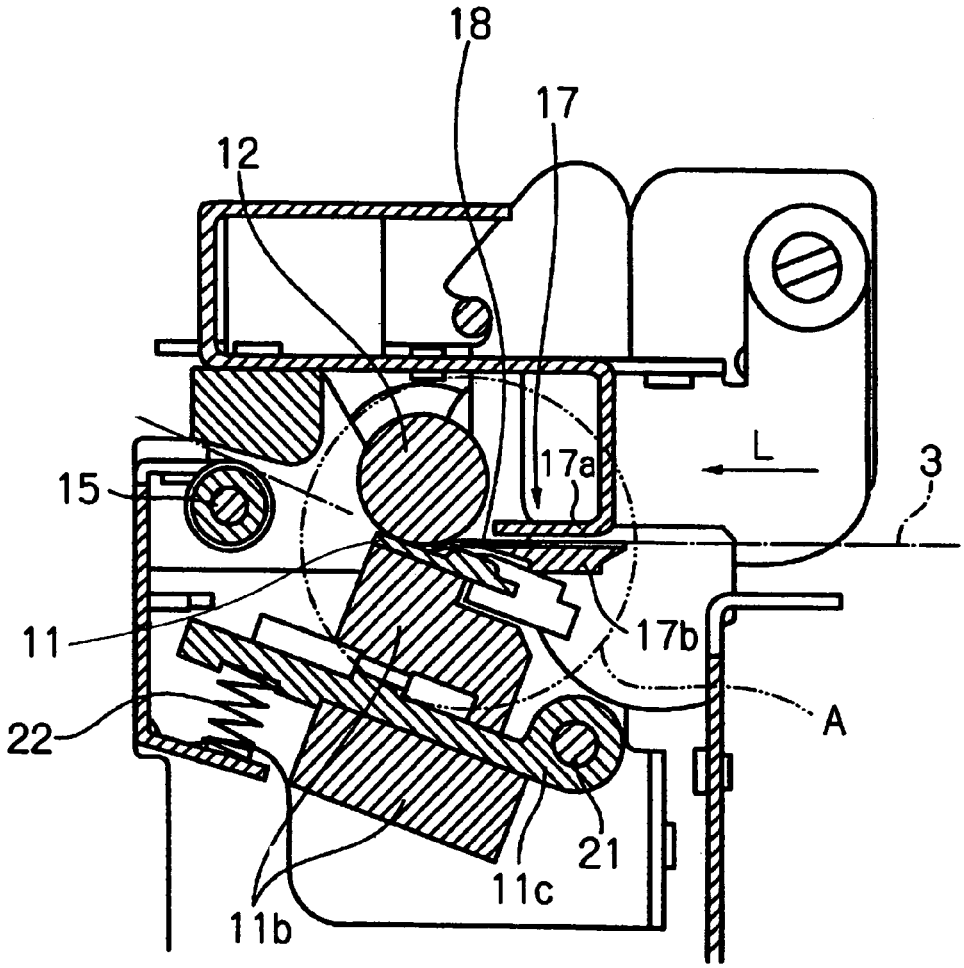
FIG. 2 is across-sectional view showing the thermal activation device.
Figure 3:
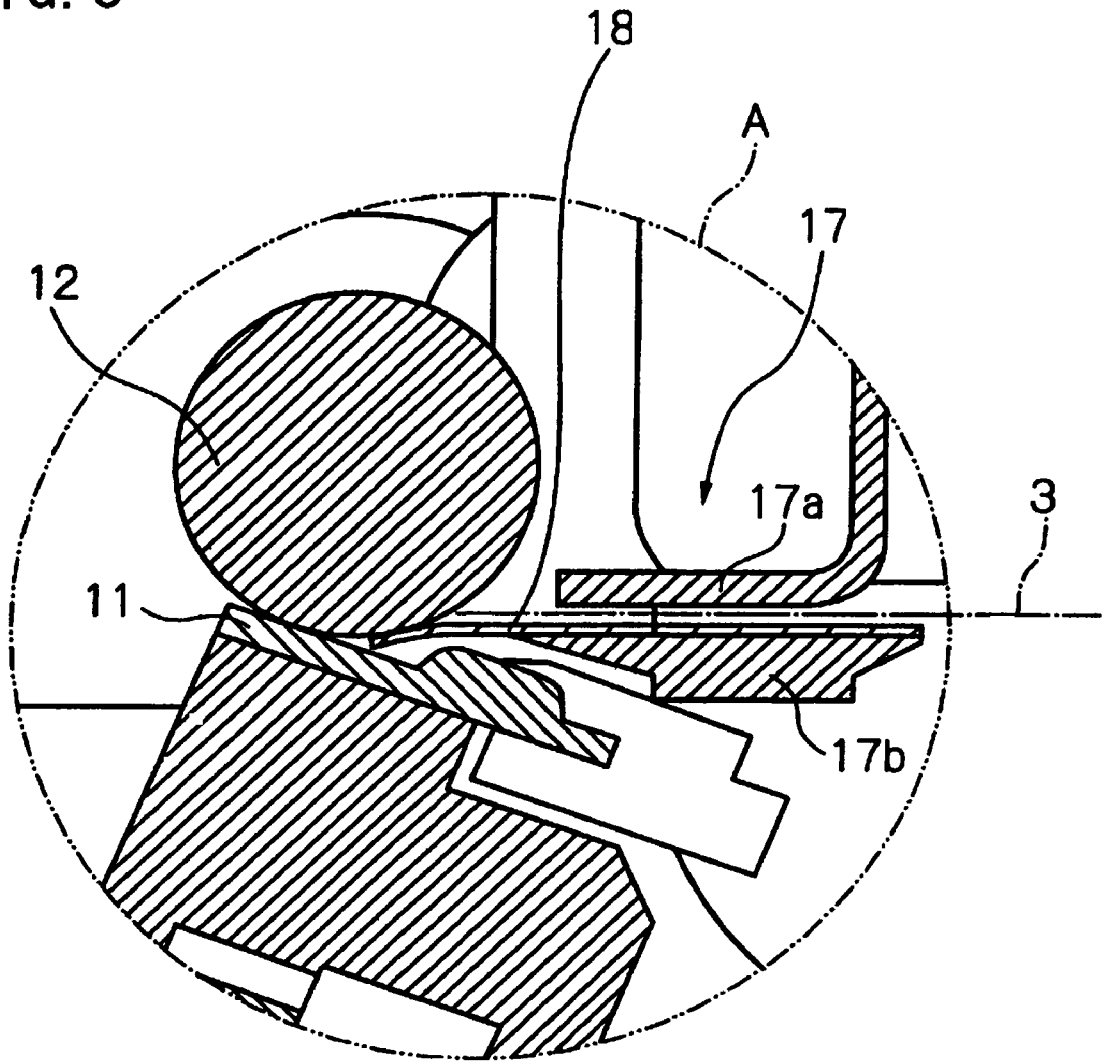
FIG. 3 is an enlarged cross-sectional view showing a part of the thermal activation device of FIG. 2.

A cross-sectional view showing a thermal activation device of this embodiment is shown in FIG. 2. An enlarged cross-sectional view of a portion A of FIG. 2 is shown in FIG. 3.

As shown in FIG. 2, the thermal activation device 10 according to a first embodiment includes a thermal activation head 11 for thermally activating the heat-sensitive adhesive layer of the sheet material 3, a platen roller 12 which is brought into press contact with the thermal activation head 11 and conveys the sheet material 3 in the conveying direction as the direction indicated by the arrow L while sandwiching the sheet material 3 between the platen roller 12 itself and the thermal activation head 11, a sheet guide portion 17 for guiding a position of the sheet material 3 in its thickness direction, which is conveyed from the cutting apparatus 7, a plate spring 18 for urging the sheet material 3 to be pressed onto the platen roller 12, and a discharge roller 15 for discharging the sheet material 3 thermally activated by the thermal activation head 11 to the outside of the thermal activation device 10.

One similar to the thermal head 6*a* provided in the printing apparatus 6 is used as the thermal activation head 11, plural heating elements (not shown) are arranged along a direction of a width perpendicular to the conveying direction of the sheet material 3. The thermal activation head 11 selectively heats arbitrary heating elements, thus making it possible to thermally activate the heat-sensitive adhesive layer per dot unit in the direction of the width of the sheet material 3.

Moreover, the thermal activation head 11 is provided on a radiator 11*b*, and the radiator 11*b* is supported on a rotary support member 11*c*. One end of the rotary support member 11*c* is rotatably supported by a rotary shaft 21, and to the other end thereof, elastic force of a compression coil spring 22 is urged. Hence, the thermal activation head 11 is brought into press contact with the peripheral surface of the platen roller 12 by the urging force of the compression coil spring 22.

An outer diameter of the platen roller 12 is set at approximately 12 mm, and the platen roller 12 is rotationally driven by a drive mechanism (not shown).

The sheet guide portion 17 is provided adjacent to the thermal activation head 11 and the platen roller 12, and is formed of an upper plate portion 17*a* and a lower plate portion 17*b* which are provided at positions opposite to each other in the thickness direction of the sheet material 3. Moreover, an opposing gap between the upper plate portion 17*a* and the lower plate portion 17*b* is set at approximately 0.9 mm, and a distance of the opposing gap in parallel to the conveying direction of the sheet material 3 is set at approximately 7.8 mm. The respective dimensions are set substantially the same as those of the sheet guide portion 117 provided in the above-mentioned conventional thermal activation device 110.

As shown in FIG. 3, the plate spring 18 is formed of a metal plate, such as a stainless steel plate, having a rectangular shape whose thickness is approximately 0.3 mm. A principal surface of one end of the plate spring 18, which faces the platen roller 12 side, is brought into press contact with the peripheral surface of the platen roller 12, and the other end side thereof is joined and fixed by adhesive or the like on an opposite surface of the lower plate portion 17*b* which is opposite to the upper plate portion 17*a*. Hence, the one end of the plate spring 18, which is brought into press contact with the platen roller 12, is made elastically shiftable in a state where the plate spring 18 is supported on the sheet guide portion 17 at one end. Then, the sheet material 3 is pressed onto the peripheral surface of the platen roller 12 by the plate spring 18 over the entire width thereof.

Figure 4:
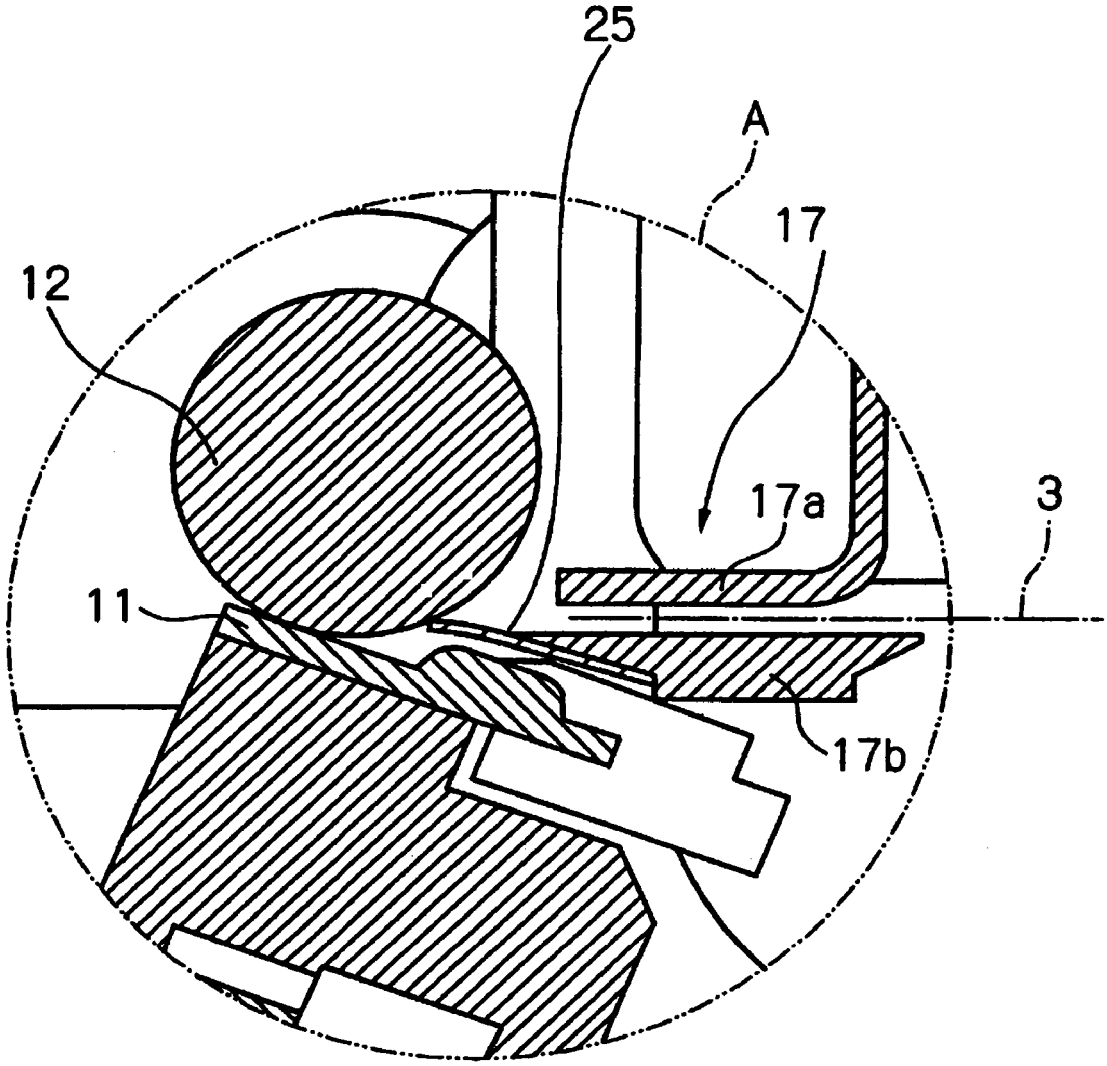
FIG. 4 is an enlarged cross-sectional view showing a part of another thermal activation device.

FIG. 4 is a cross-sectional view for explaining another plate spring, which is an enlarged view of a portion A of FIG. 2. As shown in FIG. 4, the thermal activation device 10 may also include a plate spring 25 provided so that only an outer peripheral edge of one end thereof, that is, only an edge of one side thereof, is brought into press contact with the peripheral surface of the platen roller 12.

As in the case of the above-described plate spring 18, the plate spring 25 is formed of a metal plate, such as a stainless steel plate, having a rectangular shape whose thickness is approximately 0.3 mm. The spring plate 25 is joined and fixed by adhesive or the like to a lower surface of the lower plate portion 17*b* in a state where a principal surface thereof is inclined with respect to the conveying direction. Note that the construction including the plate spring 25 can be manufactured relatively easily, and accordingly, is more preferable than the construction including the plate spring 18.

With regard to the thermal activation device 10 constructed as described above, an operation of conveying the sheet material 3 will be described.

In the thermal activation device 10, the sheet material 3 is fed in from the cutting apparatus 7 side, and the sheet material 3 is inserted into the opposing gap of the sheet guide portion 17. The sheet material 3 inserted into the opposing gap of the sheet guide portion 17 is pressed onto the peripheral surface of the platen roller 12 by urging force by the plate spring 18. Thus, the slippage which occurs between the non-adhesive region of the sheet material 3 and the platen roller 12 is suppressed, and a deflection is restrained from occurring in a front portion of the non-adhesive region. Accordingly, the sheet material 3 is allowed to go forward well in the conveying direction by elastic force of the sheet material 3 itself, and conveying force for the sheet material 3 by the platen roller 12 is supplemented.

The sheet material 3 pressed onto the peripheral surface of the platen roller 12 is inserted well between the platen roller 12 and the thermal activation head 11 as the platen roller 12 is rotationally driven. Then, the heat-sensitive adhesive layer of the sheet material 3 inserted between the platen roller 12 and the thermal activation head 11 is thermally activated, and the sheet material 3 is conveyed toward the discharge roller 15 by friction force between the sheet material 3 itself and the peripheral surface of the platen roller 12, and is discharged to the outside of the thermal activation device 10 by the discharge roller 15.

As described above, according to the thermal activation device 10, the plate spring 18 which presses the sheet material 3 onto the peripheral surface of the platen roller 12 is provided, and the sheet material 3 is allowed to go forward well in the conveying direction by the elastic force of the sheet material 3 itself, thus making it possible to supplement the conveying force for the sheet material 3 by the platen roller 12. Specifically, in the thermal activation device 10, when the heat-sensitive adhesive layer of the sheet material 3 is thermally activated asymmetrically with respect to the centerline thereof in the width direction to cause the difference in friction force in the width direction of the sheet material 3, the sheet material 3 is tightly held over its entire width on the peripheral surface of the platen roller 12. As a result, the sheet material 3 will not be suspended in the vicinity of the platen roller 12, which may be caused by partial deflection of the sheet material 3 in the width direction. Moreover, the sheet material 3 is moved at substantially even speed over the width direction of the sheet material 3. Accordingly, the sheet material 3 is restrained from being conveyed while skewed with respect to the conveying direction, and the sheet material 3 can be conveyed well.

Moreover, the plate spring 18 also exerts a function of feeding the sheet material 103 into the thermal activation head 111 side by the pair of feed-in rollers 113*a* and 113*b* provided in the above-mentioned conventional thermal activation device 110, and a function as a sheet guide portion (not shown) which guides the sheet material conveyed to the feed-in rollers 113*a* and 113*b*. The feed-in rollers 113*a* and 113*b* are omitted, thus making it possible to achieve miniaturization of the entire thermal activation device.

Moreover, according to the thermal activation device 10, the adhesive region and the non-adhesive region can be individually formed well with desired widths on the heat-sensitive adhesive layer of the sheet material 3.

Note that, though the above-described thermal activation device 10 is constructed not to include the pair of feed-in rollers which feed the sheet material 3 conveyed from the cutting apparatus 7 side into the thermal activation head 11 side, the thermal activation device may also include the pair of feed-in rollers.

A thermal activation device of another embodiment will be described below. The thermal activation device of another embodiment has basically substantially the same construction as that of the thermal activation device of the above-described first embodiment. Accordingly, the same reference numerals are assigned to the same members, and description thereof will be omitted.

Second Embodiment

The thermal activation device of the above-described first embodiment has been constructed so as to utilize the urging force of the plate spring 18 in order to restrict the sheet material 3 from being skewed. In this second embodiment, the second thermal activation device constructed so as to restrict the amount of deflection of the sheet material 3 by the opposing gap of the sheet guide portion will be described.

Figure 5:
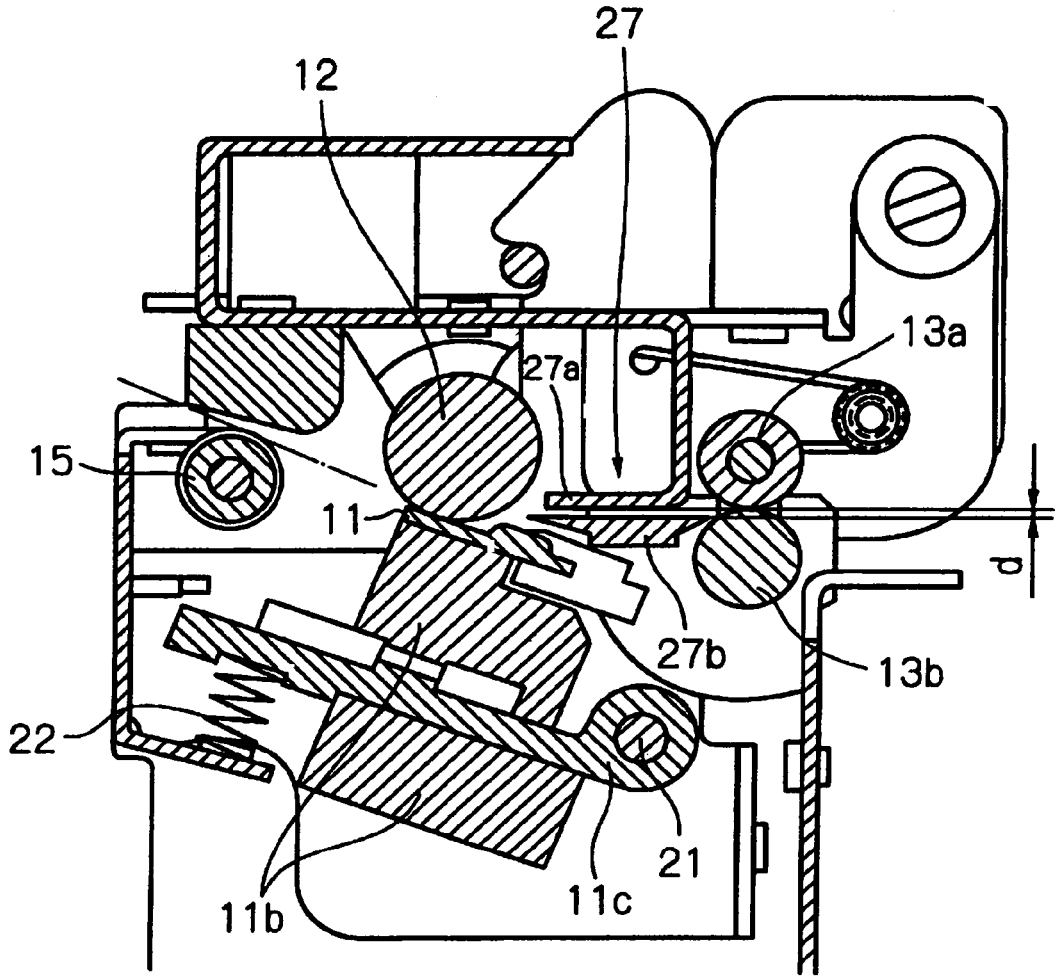
FIG. 5 is a cross-sectional view showing a thermal activation device according to a second embodiment of the present invention.

As shown in FIG. 5, a thermal activation device 20 of the second embodiment includes a pair of feed-in rollers 13*a* and 13*b* for feeding the sheet material 3 conveyed from the cutting apparatus 7 into the thermal activation device 20, and a sheet guide portion 27 having an opposing gap d which regulates an occurrence of deflection in the thickness direction of the sheet material 3 fed in by the pair of feed-in rollers 13*a* and 13*b*.

The pair of feed-in rollers 13*a* and 13*b* are provided at positions adjacent to the sheet guide portion 27, and are rotationally driven by a rotation drive mechanism (not shown). Outer diameters of the feed-in rollers 13*a* and 13 are set at approximately 8 mm.

The sheet guide portion 27 is provided adjacent to the thermal activation head 11 and the platen roller 12, and is formed of an upper plate portion 27*a* and a lower plate portion 27*b*, which are individually provided at positions opposite to each other in the thickness direction of the sheet material 3. Moreover, the opposing gap d between the upper plate portion 27*a* and the lower plate portion 27*b* is set at 0.5 mm or less, which is five times or less the thickness of the sheet material 3.

The occurrence of deflection in the thickness direction of the sheet material 3 inserted into the opposing gap d is regulated, and the amount of deflection is suppressed. Therefore, the conveying force by the feed-in rollers 13*a* and 13*b* is transmitted well to the sheet material 3 by the elastic force of the sheet material 3 itself, and the sheet material 3 is allowed to go forward well in the conveying direction by the feed-in rollers 13*a* and 13*b*, thus supplementing the conveying force for the sheet material 3 by the platen roller 12. Hence, the sheet material 3 is restrained from being conveyed while skewed with respect to the conveying direction owing to the difference in friction force which occurs in the width direction of the sheet material 3. Hence, when the heat-sensitive adhesive layer of the sheet material 3 is thermally activated asymmetrically with respect to the centerline thereof in the width direction, the sheet material 3 is conveyed well in the conveying direction.

Meanwhile, when the opposing gap d of the sheet guide portion 27 is more than five times the thickness of the sheet material 3, the amount of deflection which occurs in the width direction of the sheet material 3 inserted into the opposing gap d is not suppressed sufficiently. Accordingly, the elastic force of the sheet material 3 itself is not ensured, and the conveying force for the sheet material 3 by the platen roller 12 cannot be supplemented.

Note that, although it is desirable to reduce the opposing gap d as much as possible for the purpose of suppressing the amount of deflection of the sheet material 3, it is preferable to set the opposing gap d at approximately twice to third times the thickness of the sheet material 3, that is, at approximately 0.2 to 0.3 mm, in consideration of dimensional accuracy which may vary depending on manufacturing fluctuations.

Moreover, a distance of the opposing gap d of the sheet guide portion 27, which is in parallel to the conveying direction of the sheet material 3, is set at approximately 7.8 mm, that is, to the same extent as that of the sheet guide portion 117 provided in the above-described conventional thermal activation device 110.

Moreover, in the sheet guide portion 27, a regulating piece (not shown), which regulates movement, in the width direction, of the sheet material 3 fed into the thermal activation head 11 side, may be provided according to needs.

According to the above-described thermal activation device 20, there is provided the sheet guide portion 27, in which the opposing gap d is set at five times or less the thickness of the sheet material 3. Thus, by the opposing gap d, the occurrence of the deflection on the sheet material 3 is regulated, and the amount of deflection is suppressed. Accordingly, the sheet material 3 conveyed by the platen roller 12 is restrained from being skewed with respect to the conveying direction owing to the difference in friction force which occurs in the width direction of the sheet material 3.

Third Embodiment

A thermal activation device of this embodiment is different from the thermal activation devices of the respective embodiments described above in that the feed-in rollers are arranged close to the platen roller side, thus being constructed to suppress the amount of deflection which occurs in the sheet material between the feed-in rollers and the platen roller.

Figure 6:
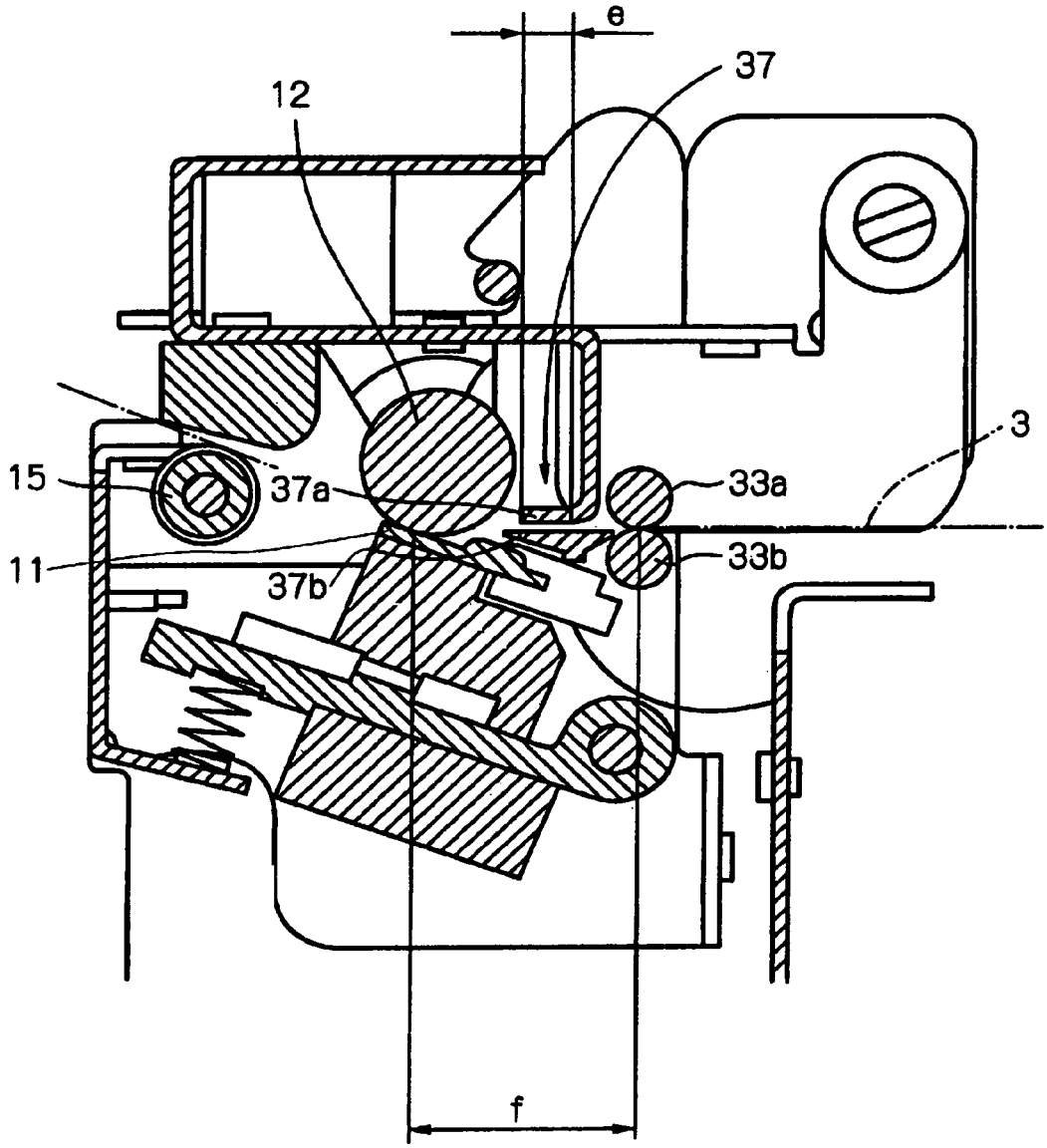
FIG. 6 is a cross-sectional view showing a thermal activation device according to a third embodiment of the present invention.
Figure 7:
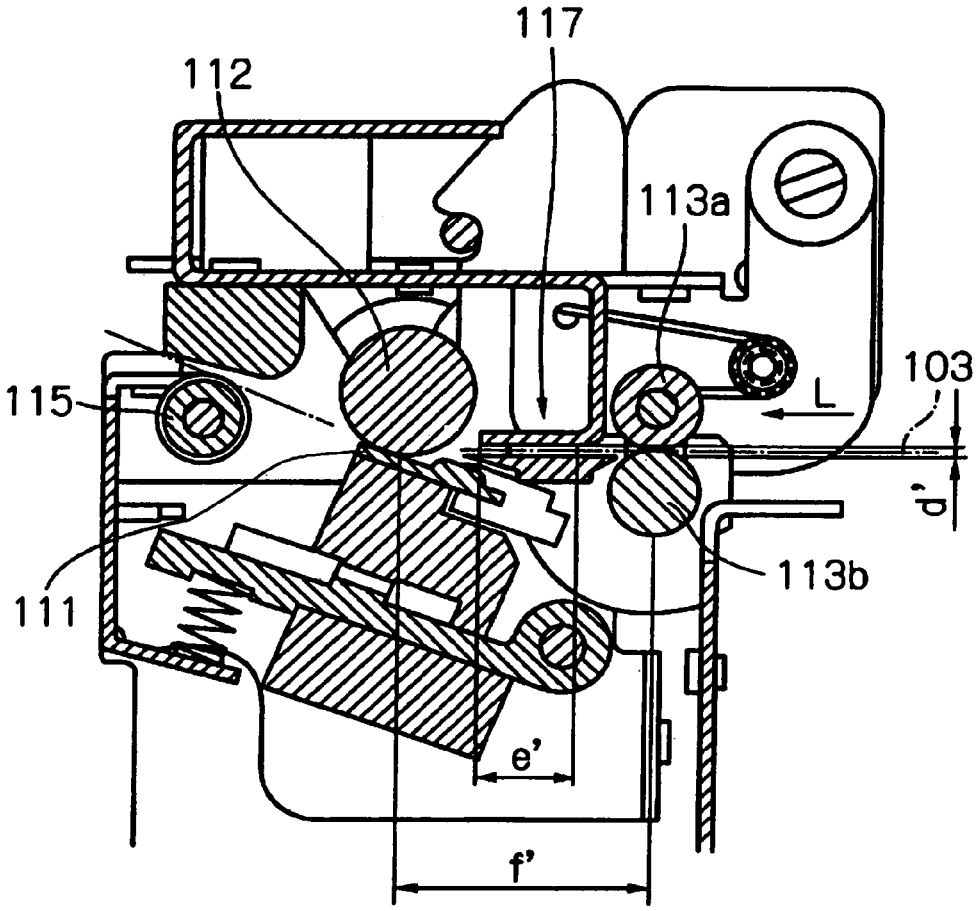
FIG. 7 is a cross-sectional view showing a conventional thermal activation device.

As shown in FIG. 6, a thermal activation device 30 of the third embodiment includes a pair of feed-in rollers 33*a* and 33*b* for feeding the sheet material 3 conveyed from the cutting apparatus 7 into the thermal activation device 30, and a sheet guide portion 37 having an opposing gap d which regulates an occurrence of deflection in the thickness direction of the sheet material 3 fed in by the pair of feed-in rollers 33*a* and 33*b*.

The pair of feed-in rollers 33*a* and 33*b* are provided at positions adjacent to the sheet guide portion 37, and are rotationally driven by a rotation drive mechanism (not shown). Outer diameters of the feed-in rollers 33*a* and 33 are set at approximately 5 mm.

Moreover, a distance f between an upstream-side holding position of the sheet material 3, where the sheet material 3 is held by the respective feed-in rollers 33*a* and 33*b*, and a downstream-side holding position of the sheet material 3, where the sheet material 3 is held by the platen roller 12 and the thermal activation head 11, is set at approximately 17.0 mm that is the sum of an outer diameter (5 mm) of each of the feed-in rollers 33*a* and 33*b* and an outer diameter (12 mm) of the platen roller 12. Note that it is preferable to reduce the distance f as much as possible in order to sufficiently suppress an amount of deflection which occurs in the sheet material 3 between the above-described upstream-side holding position and downstream-side holding position.

As described above, in the thermal activation device 30 of this embodiment, the distance f is made smaller than the distance f' in the above-mentioned conventional thermal activation device 110, and the respective feed-in rollers 33*a* and 33*b* are arranged close to the platen roller 12 side. Thus, the amount of deflection which occurs in the sheet material 3 between the upstream-side holding position and the downstream-side holding position is reduced.

The sheet guide portion 37 is provided adjacent to the thermal activation head 11 and the platen roller 12, and is formed of an upper plate portion 37*a* and a lower plate portion 37*b* which are individually provided at positions opposite to each other in the thickness direction of the sheet material 3. An opposing gap between the upper plate portion 37*a* and the lower plate portion 37*b* of the sheet guide portion 37 is set at approximately 0.9 mm, which is approximately the same as the opposing gap of the sheet guide portion 117 provided in the above-described conventional thermal activation device 110.

Moreover, with regard to the opposing gap of the sheet guide portion 37, a distance e thereof in the conveying direction of the sheet material 3 is set at approximately 2.8 mm that is half or less of a circumference ($5\pi \approx 7$ mm) of each feed-in roller. As described above, in the thermal activation device 30 of this embodiment, the distance e is made smaller than the distance e' in the above-mentioned conventional thermal activation device 110, and the respective feed-in rollers 33*a* and 33*b* are arranged close to the platen roller 12 side.

Note that, as in the case of the above-mentioned sheet guide portion 27, the opposing gap of the sheet guide portion 37 may be set at five times or less the thickness of the sheet material 3, thus making it possible to further suppress the amount of deflection which occurs in the sheet material 3.

According to the thermal activation device 30 described above, the distance f between the upstream-side holding position of the sheet material 3, where the sheet material 3 is held by the respective feed-in rollers 33*a* and 33*b*, and the downstream-side holding position of the sheet material 3, where the sheet material 3 is held by the platen roller 12 and the thermal activation head 11, is set equal to or less than the sum of the outer diameter of each of the feed-in rollers 33*a* and 33*b* and the outer diameter of the platen roller 12. Thus, the feed-in rollers 33*a* and 33*b* are arranged close to the platen roller 12 side. Accordingly, the amount of deflection which occurs in the sheet material 3 between the feed-in rollers 33*a* and 33*b* and the platen roller 12 is suppressed. Therefore, the conveying force by the feed-in rollers 33*a* and 33*b* is transmitted well to the sheet material 3 by the elastic force of the sheet material 3 itself, and the sheet material 3 is allowed to go forward in the conveying direction, thus supplementing the conveying force for the sheet material 3 by the platen roller 12.

Hence, according to the thermal activation device 30, when the heat-sensitive adhesive layer is thermally activated asymmetrically with respect to the centerline of the sheet material 3 in the width direction, the conveying speed by the platen roller 12 is made substantially even over the width direction of the sheet material 3, thus making it possible to restrain the sheet material 3 from being conveyed while skewed with respect to the conveying direction owing to the difference in friction force which occurs in the width direction of the sheet material 3.

Note that, for the thermal activation device according to the present invention, any combination of the following constructions may also be used: a construction including the plate spring for pressing the sheet material onto the peripheral surface of the platen roller; a construction in which the opposing gap of the sheet guide portion is set at five times or less the thickness of the sheet material; and a construction in which the distance between the upstream-side holding position of the sheet material, where the sheet material is held by the pair of feed-in rollers, and the downstream-side holding position of the sheet material, where the sheet material is held by the platen roller and the thermal activation head, is set equal to or less than the sum of the outer diameter of each feed-in roller and the outer diameter of the platen roller. In this way, it is possible to further restrain the sheet material conveyed by the platen roller from being skewed.

In the thermal activation device of each of the above-described embodiments, mentioned has been an example of the case of conveying the sheet material having the adhesive region and the non-adhesive region on the heat-sensitive adhesive layer. However, the present invention is suitable for application to the case of conveying a sheet material in which a friction coefficient is made uneven in the width direction of the sheet material according to needs such as pasting a label to an article so as to make it possible to easily peel off the label therefrom. For example, the above-described case includes the case of conveying a sheet material having a strong adhesive region and a weak adhesive region, in which extents of adhesiveness are different from each other, by differentiating a ratio of the adhesive region per dot unit.

Moreover, although the sheet material having the thermal printing layer has been adopted in the thermal activation device of the above-described embodiments, it is a matter of course that another sheet material having, for example, a pressure-sensitive printing layer and the like may be used.

What is claimed is:

1. A thermal activation device, comprising:

heating means for thermally activating a heat-sensitive adhesive layer of a sheet material having a printing layer provided on one surface of a sheet-like base material and having the heat-sensitive adhesive layer provided on the other surface thereof;

a platen roller for holding and conveying the sheet material, the platen roller being brought into press contact with the heating means, the heating means thermally activating the heat-sensitive adhesive layer asymmetrically with respect to a centerline in a width direction perpendicular to a conveying direction of the sheet material; and urging means for urging the sheet material to be pressed onto a peripheral surface of the platen roller, the urging means being located on an upstream side of the heating means in the conveying direction of the sheet material.

2. A thermal activation device according to claim 1, wherein the urging means comprises a plate spring provided such that one end of the plate spring is pressed onto the peripheral surface of the platen roller.

3. A thermal activation device according to claim 2, wherein a principal plane of the one end of the plate spring is pressed onto the peripheral surface of the platen roller.

4. A thermal activation device according to claim 2, wherein an outer peripheral edge of the one end of the plate spring is pressed onto the peripheral surface of the platen roller.

5. A thermal activation device according to claim 2, further comprising sheet guide means for guiding a position in a thickness direction of the sheet material fed toward the heating means, wherein the plate spring is fixed to the sheet guide means.

6. A thermal activation device according to claim 1, further comprising:

a pair of feed-in rollers for feeding the sheet material into the heating means side; and sheet guide means having an opposing gap, for guiding a position in a thickness direction of the sheet material fed in by the pair of feed-in rollers, the sheet guide means being provided adjacent to the heating means and the platen roller, wherein a thickness of the opposing gap is five times or less a thickness of the sheet material.

7. A thermal activation device according to claim 6, wherein the pair of feed-in rollers are provided at a position adjacent to the sheet guide means, and wherein a distance of the opposing gap of the sheet guide means in the conveying direction of the sheet material is a half of a circumference of each of the feed-in rollers or less.

8. A thermal activation device according to claim 1, further comprising a pair of feed-in rollers for feeding the sheet material toward the heating means, wherein a distance between an upstream-side holding position of the sheet material, where the sheet material is held by the pair of feed-in rollers, and a downstream-side holding position of the sheet material, where the sheet material is held by the platen roller and the heating means, is equal to or less than a sum of an outer diameter of each of the feed-in rollers and an outer diameter of the platen roller.

9. A thermal activation device according to claim 1, wherein the heating means comprises a thermal head.

10. A thermal activation device, comprising:

heating means for thermally activating a heat-sensitive adhesive layer of a sheet material having a printing layer provided on one surface of a sheet-like base material and having the heat-sensitive adhesive layer provided on the other surface thereof;

a platen roller for holding and conveying the sheet material, the platen roller being brought into press contact with the heating means;

a pair of feed-in rollers for feeding the sheet material toward the heating means; and sheet guide means having an opposing gap, for guiding a position in a thickness direction of the sheet material fed in by the pair of feed-in rollers, the sheet guide means being provided adjacent to the heating means and the platen roller;

wherein the heating means thermally activates the heat-sensitive adhesive layer asymmetrically with respect to a centerline in a width direction perpendicular to a conveying direction of the sheet material, and wherein the opposing gap of the sheet guide means is five times or less a thickness of the sheet material.

11. A thermal activation device according to claim 10, wherein the pair of feed-in rollers are provided at a position adjacent to the sheet guide means, and wherein a distance of the opposing gap of the sheet guide means in the conveying direction of the sheet material is a half of a circumference of each of the feed-in rollers or less.

12. A thermal activation device, comprising:

heating means for thermally activating a heat-sensitive adhesive layer of a sheet material having a printing layer provided on one surface of a sheet-like base material and having the heat-sensitive adhesive layer provided on the other surface thereof;

a platen roller for holding and conveying the sheet material, the platen roller being brought into press contact with the heating means; and a pair of feed-in rollers for feeding the sheet material toward the heating means, wherein the heating means thermally activates the heat-sensitive adhesive layer asymmetrically with respect to a centerline in a width direction perpendicular to a conveying direction of the sheet material, and wherein a distance between an upstream-side holding position of the sheet material, where the sheet material is held by the pair of feed-in rollers, and a downstream-side holding position of the sheet material, where the sheet material is held by the platen roller and the heating means, is equal to or less than a sum of an outer diameter of each of the feed-in rollers and an outer diameter of the platen roller.

* * * * *